United States Patent [19]

Yoshimura et al.

[11] Patent Number: 4,568,811

[45] Date of Patent: Feb. 4, 1986

[54] HIGH FREQUENCY HEATING UNIT WITH ROTATING WAVEGUIDE

[75] Inventors: Hirofumi Yoshimura; Masahiro Nitta, both of Nara; Yoshiyuki Takada, Sakurai, all of Japan

[73] Assignee: Matsushita Electric Industrial Co., Ltd., Kadoma, Japan

[21] Appl. No.: 664,869

[22] Filed: Oct. 25, 1984

[30] Foreign Application Priority Data

Dec. 15, 1983 [JP] Japan ..... 58-236626

[51] Int. Cl.[4] ..... H05B 6/72

[52] U.S. Cl. ..... 219/10.55 F; 219/10.55 D

[58] Field of Search ..... 219/10.55 F, 10.55 R, 219/10.55 A, 10.55 D

[56] References Cited

U.S. PATENT DOCUMENTS

| | | | |
|---|---|---|---|
| 4,176,266 | 11/1979 | Kaneko et al. | 219/10.55 F |
| 4,327,266 | 4/1982 | Austin et al. | 219/10.55 F |
| 4,430,538 | 2/1984 | Suzuki et al. | 219/10.55 F |
| 4,431,888 | 2/1984 | Simpson | 219/10.55 F |
| 4,476,362 | 10/1984 | Kusunoki et al. | 219/10.55 F |
| 4,496,814 | 1/1985 | Fitzmayer | 219/10.55 F |

FOREIGN PATENT DOCUMENTS

| | | | |
|---|---|---|---|
| 47-35741 | 10/1972 | Japan . | |
| 48-2144 | 1/1973 | Japan . | |
| 54-9036 | 1/1979 | Japan | 219/10.55 F |
| 56-15594 | 2/1981 | Japan . | |

*Primary Examiner*—Philip H. Leung

*Attorney, Agent, or Firm*—Wenderoth, Lind & Ponack

[57] ABSTRACT

This invention is designed to make uniform the heating of the object inside the heating chamber by turning an internal waveguide which is roughly in a foldable fan shape and located at the bottom of the heating chamber in a structure adapted for feeding high frequency electric waves from the bottom of the heating chamber. In order to have stable gyration of the internal waveguide, and annular protrusion made of a low loss dielectric is placed between the low impedance parts provided on the internal waveguide and the heating chamber bottom surface. In this way, a rotary structure which is economical, easy to assemble and reliable can be realized.

14 Claims, 9 Drawing Figures

HIGH FREQUENCY HEATING UNIT WITH ROTATING WAVEGUIDE

TECHNICAL FIELD

The present invention relates to heating object uniformly in a high frequency heating unit by feeding high frequency electric waves from the bottom of the heating chamber and by use of a rotary waveguide.

BACKGROUND ARTS

There are a large number of prior art heating units which relate to making the heating distribution in high frequency heating units uniform. They are largely classified into a stirrer system in which metal vanes are turned in a heating chamber, a turntable system in which the object to be heated is turned and a rotary antenna system in which the antenna, which is the source of radiation of electromagnetic waves, is turned. Among them, the rotary antenna system which has small dimensions and which gives high uniformity of wave distribution is often utilized. The method of radiating electromagnetic waves from the bottom of the heating chamber using the rotary antenna system results in less nonuniform heating due to the standing waves inside the heating chamber, because the electromagnetic waves radiated are directly absorbed by the load, and therefore there is less influence from the dimensions of the heating chamber, which is an advantage, but it is defective in that the center of gyration is heated very intensively. As one of means for solving such a problem, there has been proposed a method comprising adjusting the length of the horizontal part of the rotary strip antenna, as reported in Japanese Laid-Open Patent application No. 15594 of 1981. According to this method, the overheating at the center of gyration is inhibited by adjusting the alignment of impedance between the horizontal rotary strip antenna and the object being heated. Therefore, if the shape and/or size of the load is changed, the radiation from the rotary strip antenna will be altered. Thus this method makes heating uniform for some limited loads, but has only a small effect on different loads.

For whatever load, it seems difficult with a strip antenna to diminish the radiation of electromagnetic waves at the center of gyration and propagate them in the horizontal direction.

As a method of propagating electromagnetic waves from the center of gyration in the horizontal direction, an arrangement for turning a flume shape rotary wave guide has been proposed, as disclosed in Japanese Patent Publication No. 2144 of 1973. In this arrangement, the coupling of the feeding port with the rotary waveguide is difficult. That is to say, because the direction of the electric field at the feeding port is fixed, when the rotary wave guide and the direction of the electric field coincide with each other, the electric wave is propagated through the flume shape rotary wave guide, but when they cross each other at a right angle, the electric waves are barely propagated. Thus in whichever direction the rotary waveguide is turned, the electric waves will in no event be propagated through the rotary wave guide. Accordingly, the heating distribution is differentiated between fore-and-aft and right-and-left.

In Japanese the arrangement disclosed in Utility Model Publication No. 35741 of 1972, with the antenna and the wave guide coupled, the rate of propagation of electric waves through the waveguide is unaltered, even if the turning direction is changed, but since the antenna and the wave guide are not electrically in contact with each other, not all of the electric waves on the antenna are propagated to the waveguide. On this account, it becomes necessary to provide for a labyrinth for the electric waves on the outer circumference of the waveguide, resulting in a complex waveguide.

In addition, a method of turning a waveguide having a plurality of openings with different radii of gyration at the bottom of an oven as disclosed in U.S. Pat. No. 4,314,127 has been contemplated. By this method, parts of the object being heated (food) near the openings are well heated, but its upper parts are only slightly heated like on a frying pan. Since it is impossible to equalize the rates of radiation of electric waves from the plurality of openings in accordance with whatever load is present such as various foods, consequently their distribution on a plane is not favorable.

DISCLOSURE OF THE INVENTION

The present invention, designed to solve such prior art problems, provides a structural arrangement which not only greatly improves the uniformity of electric wave distribution, but which also minimizes the dispersion of the uniformity of distribution by a simple arranging means. In addition, stable performance will be maintained, even if any seepage of liquid from the food inside the heating chamber has occurred.

In the structural arrangement adopted for achieving the aforementioned objects and in which the electric waves are fed from the bottom of the heating chamber, a foldable fan shape antenna coupled by the magnetic field is rotated and low impedance parts are provided outside the arc part, whereby the usual problem of overheating at the central bottom of the chamber is averted, so as to ensure uniform heating of whatever food is present.

DESCRIPTION OF THE PREFERRED EMBODIMENTS

Figure 1:
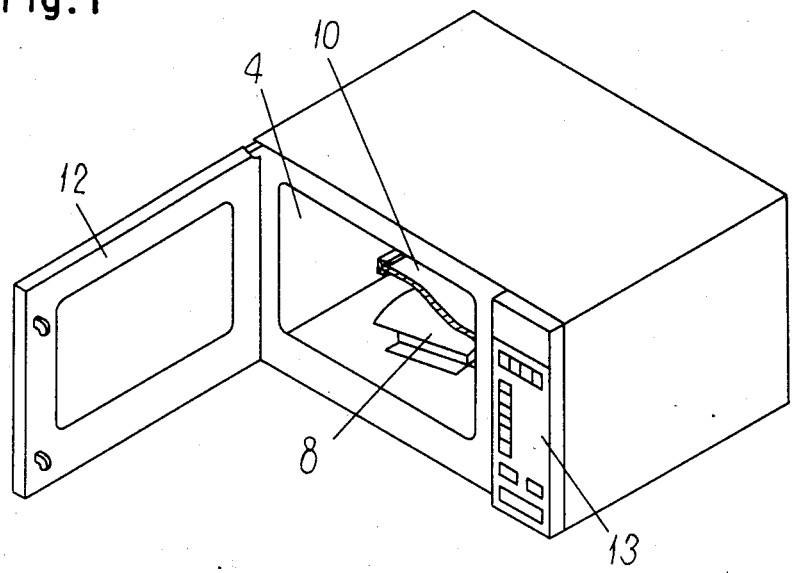
FIG. 1 is a perspective view of a high frequency heating unit according to this invention, showing its appearance.

In the following, an embodiment of this invention is described with reference to FIGS. 1 and 2:

Numeral 1 in the figures denotes a high frequency oscillator which receives the high voltage power fed through a voltage doubler circuit (not shown in these figures) composed of a high tension transformer, high tension capacitor and high tension diode, converts this high voltage power into electric waves and radiates the electric waves into a wave guide 3 through an antenna 2. The electric waves radiated into the wave guide 3 are propagated through the inside of the wave guide 3 and radiated into the heating chamber 4 through the feeding port 5 located roughly at the center of the bottom of the heating chamber 4 composed of thin metal and in the shape of a cube. At this feeding port 5, there is provided a coupling rod 6 made of a metal which couples the heating chamber 4 and the wave guide 3 in a high frequency coupling for facilitating radiation of the electric waves into the heating chamber 4. Further, on one end of this coupling rod 6 is mounted an internal wave guide 8 made of a metal and having a box shape and covering the aforementioned feeding port 5, and which is spaced a certain distance from the bottom of the aforementioned heating chamber 4 and which is provided at its end with an opening 7 which opens toward the heating chamber 4. The other end of the coupling rod 6 is coupled with a motor 9, so that the coupling rod 6 and the internal wave guide 8 are rotatable. Accordingly, the electric waves led to the feeding port 5 of the heating chamber 4 pass along the coupling rod 6, are propagated through the internal waveguide 8 and pass through the opening 7, to be radiated into the heating chamber 4. Above the internal wave guide 8 in the heating chamber 4 is positioned, a table 10 composed of a dielectric, such that the radiated electric waves are absorbed through this table by the object being heated (not shown in these figures) placed on the table 10. The internal wave guide 8 is arranged to be rotatable as above-described, so that the electric waves radiated through the opening 7 are absorbed by the object of heating more efficiently and more uniformly.

Numeral 12 in these figures designates an openable and closeable door for passing the object of heating into and out of the heating chamber 4, and 13 designates a control panel for an ON/OFF the power switch for the high frequency heating unit or for changing the output of the electric waves.

On the bottom of the heating chamber 4, a ridge-shaped protrusion 11 is provided concentrically with the feeding port 5 and outside the opening 7. This prevents oil or water from the food, if the object of heating is a food and if it should seep under the table, from entering between the internal waveguide 8 and the bottom of the heating chamber or entering into the motor 9, causing spark discharge due to high frequency electromagnetic waves or otherwise causing failure of the motor 9. In addition, on the outside of the protrusion 11, small holes 13 which permit oil and water from the food escape from the heating chamber 4 are provided.

Figure 2:
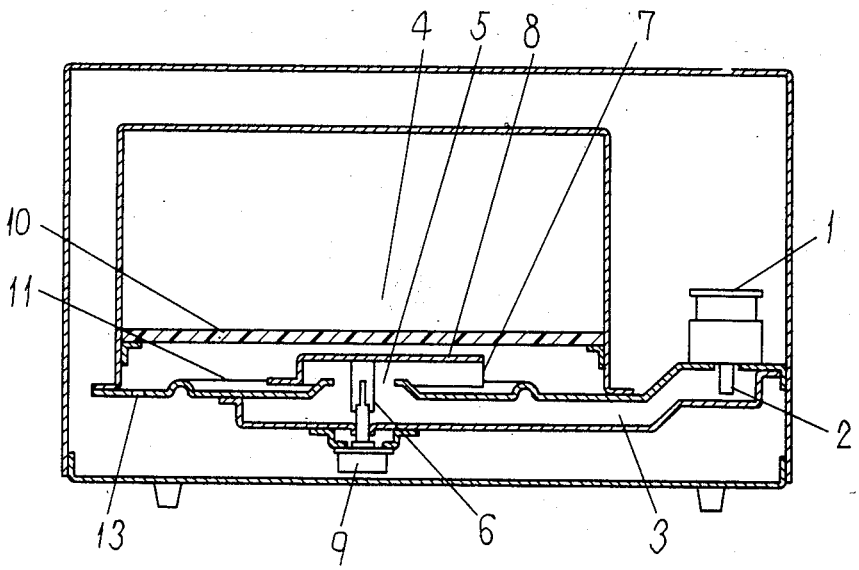
FIG. 2 is a front sectional view of the unit of FIG. 1.
Figure 3:
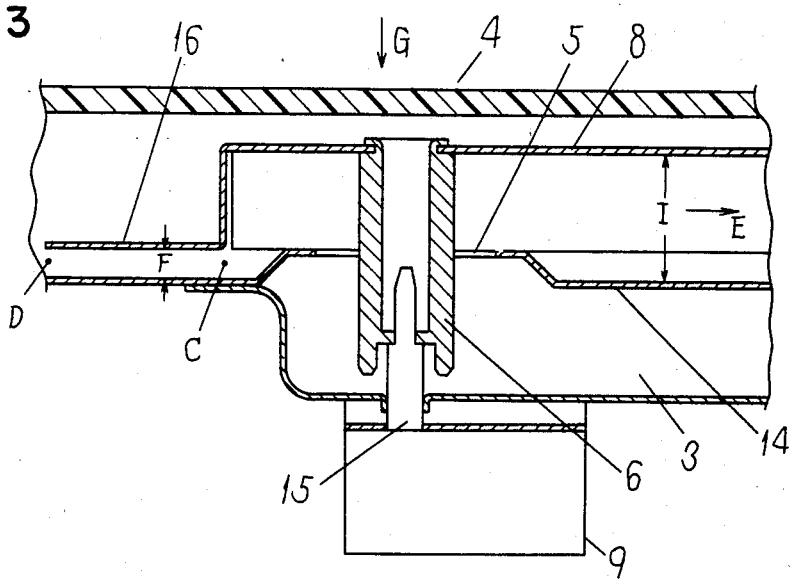
FIG. 3 is an enlarged view of an essential part of the unit of FIG. 1.

FIG. 3 is an enlarged view the heating chamber bottom part of FIG. 2 at about the center of the wall 14 of the heating chamber 4, the feeding port 5 is provided. The part of the heating chamber bottom wall 14 around the feeding port 5 is raised a little, lest any liquid seepage from the food easily flow down into the motor 9. The shaft 15 of the motor 9 is made of a low loss dielectric, so that the high frequency electromagnetic waves inside the waveguide 3 will not leak out to the motor 9 as well as making the transmission of heat inside the heating chamber 4 to the motor 9 difficult. The coupling rod 6 is mounted on the shaft 15 to be turned thereby. The coupling rod 6 leads the high frequency electromagnetic waves in the wave guide 3 into the heating chamber 4. The internal waveguide 8 is caulked onto the tip of the coupling rod 6 inside the heating chamber and, electrically and mechanically locked there. Accordingly, the high frequency electromagnetic waves are propagated between the internal waveguide 8 and the heating chamber bottom wall 14. At one end of the internal waveguide 8, there is provided a low impedance part 16 having a length about one fourth of the wave length of the high frequency electromagnetic wave and spaced from bottom wall 14 a distance F. By this means, the high frequency electromagnetic waves inside the space between the internal waveguide 8 and the heating chamber bottom wall 14 are reflected by this low impedance part 16. The reason can be explained as follows: Since the characteristic impedance of the heating chamber is approx. 300Ω and the low impedance part 16 has approx. 20Ω, the impedance of the opening C is calculated by $20\times20\div300$ to be about 1Ω, assuming the length of the low impedance part to be one quarter wave length. Accordingly, because the characteristic impedance of the internal waveguide 8 is determined from the dimension I to be approx. 80Ω, the reflection coefficient will be approx. 0.98. Thus 98% of the electric waves inside the internal waveguide 8 are reflected and therefore, hardly any electric waves will come out through the opening D. For this reason, the electric waves in the internal waveguide 8 will be propagated mostly in the direction E. The above-description clearly indicates the paramount importance of the distance F between the low impedance part 16 and the heating chamber bottom wall 14.

Figure 4:
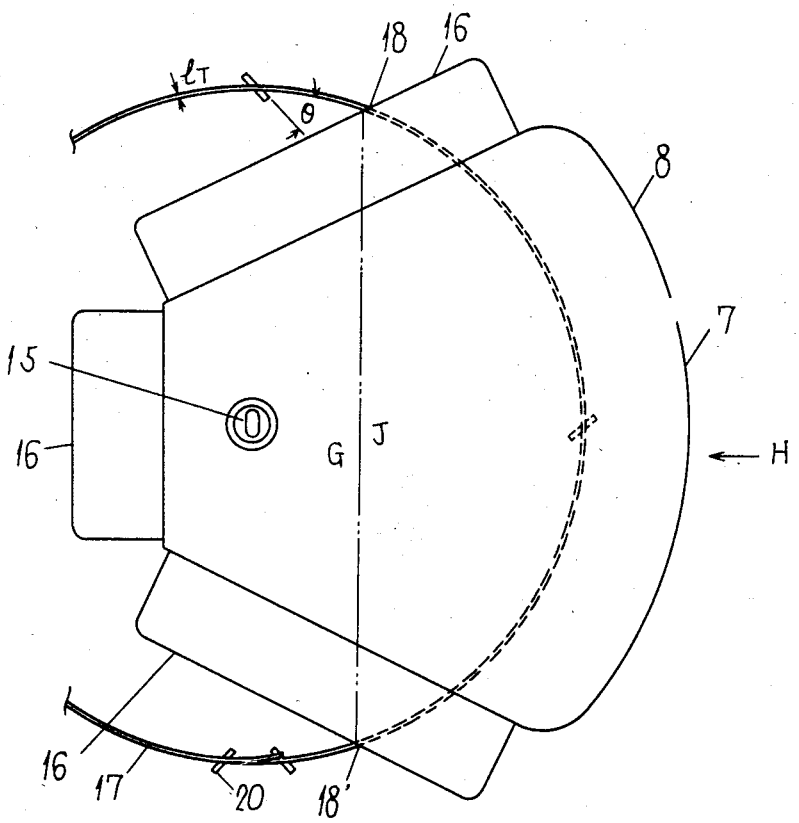
FIG. 4 is a plan view of the part shown in FIG. 3, as seen from the direction indicated by the arrow G in FIG. 3.

FIG. 4 is a view as seen in the direction indicated by an arrow G in FIG. 3. The internal waveguide 8 is roughly in a fan shape with low impedance parts 16 provided outside the angular shaped part and the rear of the internal waveguide 8, to reflect the electric waves, so that the electric waves are radiated from the front end of the internal waveguide 8. Accordingly, the electric wave radiating opening 7 is turned and the electric field in the radiating opening 7 is in the vertical direction and excites the inside of the heating chamber.

In this way, the bottom part of the load such as food, etc., is heated by the electric waves leaking through the low impedance parts 16, but the whole of the food can be heated by the electric waves from the opneing 7. Since the direction of the electric field of the electric waves from the opening 7 is vertical, a vertical electric field is produced inside the heating chamber 4 and therefore, the uniformity is stabilized for so-called planar food having abundant horizontal components. Between the internal waveguide 8 and the heating chamber bottom wall 14, there is provided an arc shaped antenna spacer 17 which is formed of a low loss dielectric for stabilization of the dimension F of FIG. 3.

The internal waveguide 8 and the coupling rod 6 are supported by two contacting points 18 and 18' of the antenna spacer 17 and the low impedance parts 16 and by the shaft 15, thus at three positions in all, and the center of gravity G of the internal waveguide 8 and the coupling rod 6 is designed to be located on the shaft side from the straight line between the contact points 18 and 18', so that the internal waveguide 8 will be stable during turning.

Since the position of the opening 7 is so set as to be farther from the center than the usual radius of the food, the electric waves coming from the bottom do not come directly to the load. Thus this method has no disadvantage of overheating the bottom part of food which is usually present in the method of feeding from the bottom of the heating chamber, the heating of the lower part of food being effected merely by the small amount of the electric waves leaking through the low impedance parts 16.

Figure 5:
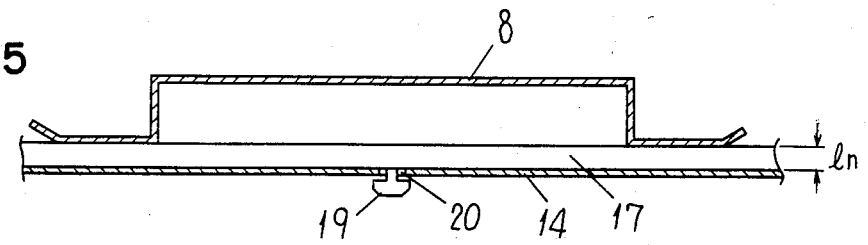
FIG. 5 is a sectional view taken along line 4—4 in FIG. 4.

FIG. 5 is a sectional view an arrow H in FIG. 4. That the antenna spacer 17 has a flat plate shape and is provided with protrusions 19 at several positions, which are inserted in small holes 20 provided in the heating chamber wall, whereby it is held in place. The small holes 20 are each formed at a definite angle $\theta$ to the arc, as shown in FIG. 4, so that the protrusions 19 will not come loose and the elasticity of the antenna spacer 17 permits snug insertion of protrusions into the small holes 20, thus enabling ready assembling.

The low impedance part 16 in the aforementioned embodiment is formed of a sheet of stainless steel plate or alumite plate, etc., in a press. As an alternative, however, the low impedance part which is held at the distance of F from the wall can be formed of a dielectric with a higher dielectric constant than that of air, e.g., ceramic, alumina ceramic, etc.

The height of the antenna spacer is chosen to be lh where the electric wave radiation from between the radiator flange part and the heating chamber bottom wall is checked to an appropriate level, but sparks, abnormal heating, etc., will not be induced between the flange part and the heating chamber bottom wall. The thickness lt is designed to be enough smaller than lh, so that not only the electric wave loss due to this rail is minimized, but the slip friction is kept as small as possible by reducing the contact area with the flange of the radiator.

Figure 6:
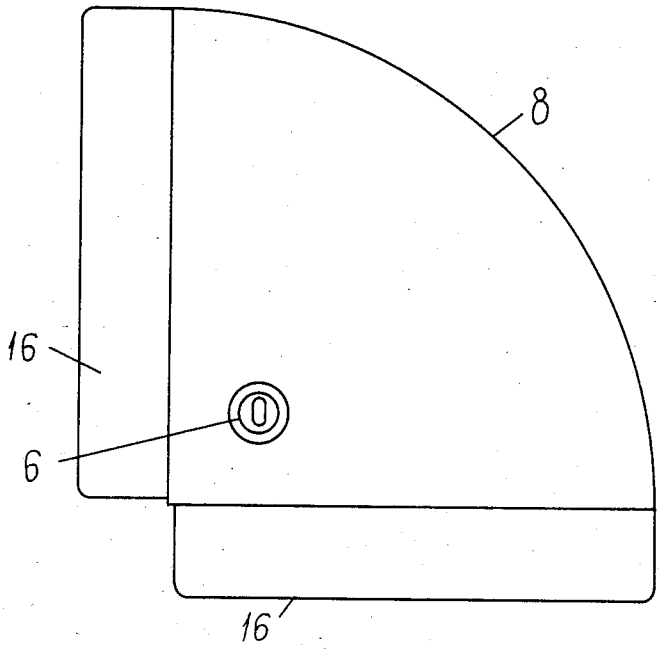
FIG. 6 is a plan view of the essential part of another embodiment of this invention.

FIG. 6 is a plan view as seen in the direction indicated by an arrow G in FIG. 3 showing another embodiment of this invention.

The internal waveguide 8 has a fan shape with the coupling rod 6 provided at its pivot. In this embodiment, roughly the same effect as in the aforementioned embodiment can be achieved.

Figure 7:
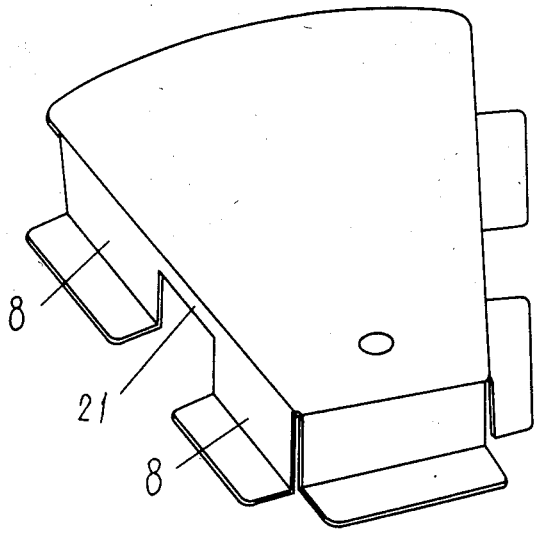
FIG. 7 is a perspective view of the essential part of another embodiment of this invention.

FIG. 7 is a view showing another embodiment of the internal waveguide, in which the radiating part is composed of a flat plate having, on each side, a parallel flat plate part 21 between the internal waveguide part 8 and another internal waveguide part 8'.

In the following, the effects obtained by the above-described structure are described:

The electric waves generated by a high frequency oscillator 1 are transmitted through the wave guide 3, excited by the coupling rod 6 and the internal wave guide 8 and then, enters the heating chamber, when they are radiated through the opening 7. Since the entrance portion of the radiating part is composed of a waveguide, the electric wave propagating direction is very well controlled toward the open end of the waveguide. However, at the end edge of the waveguide, where its side walls disappear, exposing the parallel flat plate edges, part of the electric waves having been transmitted up to this position, while being controlled in one direction, are radiated sideways, thereby intensifying the heating at about the central part of the food. The electric waves transmitted along the parallel flat plate line up to the tip of the radiating part are radiated toward the upper part of the heating chamber between the forward end of the radiating part and the wall of the heating chamber, and are reflected by the side wall and the upper wall of the heating chamber, thereby heating mainly the outer circumferential part of the food.

It is possible to adjust the heating balance between the central part and the peripheral part of the food by changing the position of the parallel flat plate part 21, shown in FIG. 7, in the radiating part.

Figure 8:
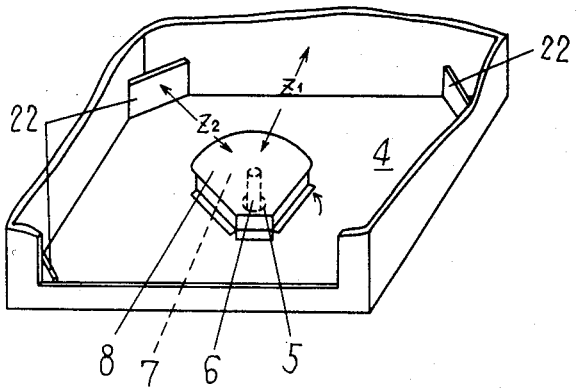
FIG. 8 is a perspective view of the essential part of the unit of this invention.

FIG. 8 is a perspective view of the essential part of another embodiment of this invention.

Referring to FIG. 8, 4 designates a heating chamber; 5, a feeding port located at the bottom of the heating chamber 4; 6, a coupling rod for coupling in a high frequency coupling the heating chamber 4 with the waveguide 3; and 8, an internal waveguide having an opening 7 at one end thereof and mounted tip of the coupling rod 6. Reflecting plates 22 are placed in positions nearly equally spaced from the opening 7 as the wall surface of the heating chamber 4, one in each corner of the heating chamber 4.

In the above described structure, observing the wall surface of the heating chamber 4 and the reflecting plate 22 from the opening 7 of the internal waveguide 8, $Z_1$ and $Z_2$ may be nearly equal in terms of impedance, because the distances from the opening 7 to the wall surface and to the reflecting plate are nearly equal. Accordingly, the impedance in the heating chamber 4 becomes stabilized with regard to the opening 7 insofar as high frequency is concerned. Thus the operation of the high frequency oscillator is stabilized and breakdown of the high frequency oscillator can be averted. Moreover, because the distances from the wall surface of the heating chamber 4 and the reflecting plates 22 to the opening 7 are equal, the radiating angle of electric waves becomes fixed. This, associated with the turning of the internal waveguide 8, enables uniform heating without irregular absorption by the object.

Figure 9:
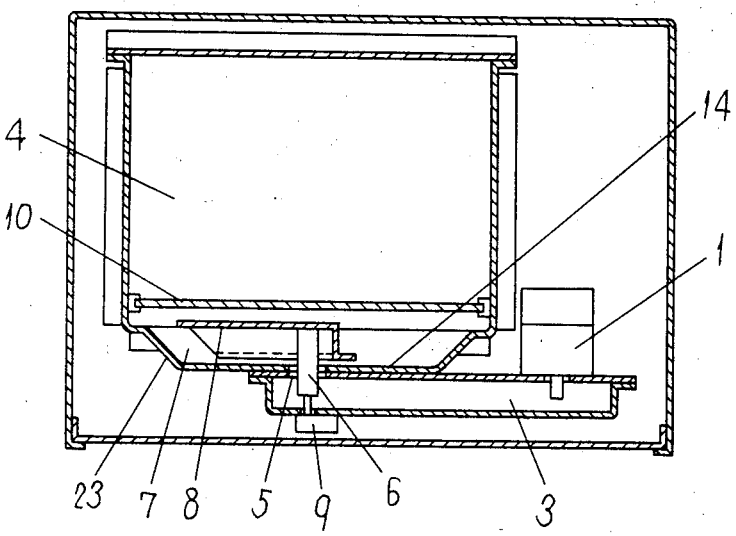
FIG. 9 is a sectional view of a heating unit having the essential part of another embodiment of this invention.

FIG. 9 is a front sectional view of another embodiment of this invention. Referring to this view, 1 denotes an oscillator for generating microwaves; 3 denotes a waveguide for transmitting the microwaves generated in the aforementioned oscillator 1; 4 denotes the heating chamber for heating the object; 5 denotes the feeding port located on the bottom wall 14 of the aforementioned heating chamber 4 for exciting the aforementioned heating chamber 4 with the microwaves transmitted through the aforementioned waveguide 3; and 6 designates the coupling rod. Numeral 8 designates a rotary waveguide having an opening at its end, which covers the aforementioned feeding port 5 and which turns in a plane parallel to the bottom wall 14 of the aforementioned heating chamber with the feeding port 5 as the center. This internal waveguide 8 is formed of a metal body and fixed to the aforementioned coupling rod 6. It is driven by a motor 9. Numeral 10 designates a table for bearing the object to be heated and which is formed of a dielectric such as glass, etc. The aforementioned heating chamber wall 14 has a circular concavity in the bottom with the center of rotation of the aforementioned internal waveguide 8 as its center.

The microwaves radiated from the aforementioned oscillator 1 pass through the aforementioned waveguide 3 and are radiated through the coupling part composed of the aforementioned feeding port 5 and the aforementioned coupling rod 6 into the space surrounded by the internal waveguide 8 inside the aforementioned heating chamber 4 and the heating chamber wall surface 14. The microwaves radiated from the aforementioned coupling part pass through the opening 7 provided at the end of the aforementioned internal waveguide 8 and the table 10, to heat the object placed in the heating chamber 4. The aforementioned internal waveguide 8 is rotationally driven by the aforementioned motor 9 to turn with the aforementioned coupling part as the center. Accordingly, the opening 7, being the microwave feeding port, is rotated and transferred, so that the microwaves may be fed from various positions at the heating chamber bottom and therefore, relatively uniform heating distribution to the object may be achieved. Since the aforementioned heating chamber wall 14 has a circular concavity with the center of rotation of the aforementioned internal waveguide 8 as its center, the distance between the sloped part 23 of the heating chamber wall facing the opening 7 of the aforementioned waveguide 8 and the aforementioned coupling part located at the center of rotation of the aforementioned internal waveguide 8 does not undergo any change during the turning of the aforementioned internal waveguide 8, but is always fixed. The aforementioned heating chamber wall 14 is formed of a metal body for enclosing the microwaves and is a reflector of electric waves, but since, as above described, the distance between the aforementioned sloped part 23 and the aforementioned coupling part is fixed, the phase of the reflecting waves which are reflected by the aforementioned sloped part 23 facing the aforementioned opening part 7 and which then return toward the aforementioned oscillator 1 remain unaltered, without undergoing change with turning of the aforementioned internal waveguide 8. Accordingly, the change in the impedance on the load side, as observed from the aforementioned oscillator 1 is small. On this account, the aforementioned oscillator 1 can operate at an operating level where its efficiency is high, so that the operation of the aforementioned oscillator 1 is stabilized, its durability improved and moreover, unnecessary radiations from the aforementioned oscillator 1 can be reduced. Besides, with the aforementioned concave part formed by drawing the metal, the amount of material for forming the aforementioned heating chamber wall.

The above described structure has the following effects:

(1) Sure propagation of electric waves from the coupling rod to the circumference of the waveguide 8 results in adequate effect of rotation and accordingly, proper heating distribution.

(2) Since the degree of heating at the lower part of the food is freely adjustable by the choice of the length of the low impedance part and the distance F, too strong or too weak heating at the lower part of the food will not occur.

(3) Because the heating chamber is excited with vertical electric waves, even if a planar shaped food undergoes changes in shape, stable uniformity is ensured in the heating.

(4) The low impedance part of the internal waveguide can be formed merely by bending a metal plate, thereby minimizing the raising cost.

(5) Because the part of the heating chamber wall around the feeding port is raised relative the outside part, liquid seepage from the food will not enter into the motor part.

(6) Since the heating is effected mainly by the radiation of electric waves, with the high frequency electromagnetic waves radiated from the bottom, changes in the uniformity of distribution will not result due to a size difference of the heating chamber. Therefore, this unit can be accommodated in heating chambers of various sizes.

(7) Because the distance of the low impedance part from the heating chamber bottom wall is fixed by means of an antenna spacer, dispersion of the products is small.

(8) Because of absence of any protrusions inside the heating chamber, this unit can be readily used and cleaned.

(9) As the protrusion is placed outside the antenna spacer, the resistance at the sliding joint between the antenna spacer and the low impedance part will not increase due to liquid seepage from the food below the table and the sliding part, being placed above the heating chamber bottom wall, is assured of rotation without being affected by a substantial amount of liquid seepage from the food.

(10) By the sliding movement between the low impedance part of the internal waveguide part and the antenna spacer, smooth turning is achieved with very small friction.

(11) By supporting the radiating body at two points of the low impedance part and one point of the coupling part, thus three points in total, very stable supporting and rotation are achieved with a minimum necessary friction.

(12) By placing the contact points between the low impedance parts and the antenna spacer outside the center of gravity of the internal waveguide and the coupling rod, as seen from the center of rotation, stable rotation and output characteristics can be achieved simply by use of a mere inserting structure for the connection between the coupling rod and the motor shaft and thereby, it becomes possible to perform reliable, high quality electric wave feeding with a simple and low cost structure.

(13) By making the thickness lt of the antenna spacer sufficiently smaller than its height lh, electric wave loss can be reduced, and reducing the size of the contact areas of the low impedance parts of the internal waveguide, the rotational friction can be greatly reduced.

(14) By making the internal waveguide a combination of the waveguide parts and the parallel flat plate parts, the heating near the center of the heating chamber can be intensified, and the electric wave heating distribution all over the heating chamber improved.

(15) With a concave part and reflecting plates placed on the heating chamber bottom, the distances from the heating chamber wall surface and from the reflecting plates or the concave part of the heating chamber bottom to the opening of the waveguide can be equalized, so that impedances can be held constant, stable operation of the high frequency oscillator obtained, and breakdown of the high frequency oscillation averted.

(16) The distances from the heating chamber wall surface and from the reflecting plates to the opening can be equalized, making it possible to fix the electric wave radiating angle, to have the electric waves absorbed by the object to be heated in a specified direction, thereby achieving a uniform heating pattern.

FIELD OF INDUSTRIAL APPLICATION

This invention relates to making the heating uniform in high frequency induction heating units generally called electronic ranges in which the high frequency induction heating is applied mainly for heating foods.

What is claimed is:

1. A high frequency heating unit comprising:

a high frequency oscillator for generating high frequency electromagnetic waves;

a heating chamber for heating an article and having a microwave port at about the center of the bottom wall thereof;

an external waveguide extending from said oscillator to said port for guiding the high frequency electromagnetic waves from the oscillator to the heating chamber;

a coupling rod extending through said external waveguide from below said external waveguide through said microwave port and into said heating chamber;

an internal waveguide securely mounted on the end of said coupling rod within said heating chamber and extending substantially perpendicularly thereto, said internal waveguide having a main waveguide opening at the radially outer end remote from said coupling rod and further having at least one auxiliary waveguide opening therein, and a plate extending from the edge of each auxiliary waveguide opening which is toward the inside of said chamber approximately one-quarter of the wavelength of the high frequency electromagnetic waves and parallel to the bottom wall of said chamber and spaced from said bottom wall a distance for forming with said bottom wall a low characteristic impedance opening; and means coupled to said coupling rod for rotating said coupling rod for rotating said internal waveguide around the longitudinal axis of said coupling rod.

2. A high frequency heating unit according to claim 1 wherein said internal waveguide has an inner wall and sidewalls depending therefrom toward said bottom wall, and said bottom wall forming the wall of said internal waveguide which is toward the bottom of said chamber, said plate being spaced from said bottom wall a distance less than one-half the distance which said inner wall of said internal waveguide is spaced from said bottom wall.

3. A high frequency heating unit according to claim 1 wherein said internal waveguide is roughly in the shape of a hand held fan with the arc portion being at the end remote from said coupling rod, said main waveguide opening being along the arc portion and the auxiliary waveguide opening being at a position other than along the arc portion.

4. A high frequency heating unit according to claim 1 in which said bottom wall has a circular concavity therein with the microwave port and coupling rod at the center thereof.

5. A high frequency heating unit according to claim 1 wherein the portion of wall around said microwave port is raised toward the interior of said chamber.

6. A high frequency heating unit according to claim 1 in which said heating chamber has a polygonal horizontal cross section, and further comprising reflecting plates in said chamber extending across the corners thereof.

7. A high frequency heating unit according to claim 1 wherein said bottom wall has a ridge-shaped protrusion concentric with said microwave port and at a radial distance therefrom corresponding to the outer end of said internal waveguide.

8. A high frequency heating unit according to claim 7 wherein said bottom wall has small holes therein radially outwardly of said ridge-shaped protrusion.

9. A high frequency heating unit according to claim 1 wherein said internal waveguide has a flat inner wall and side walls depending from the edges thereof toward said bottom wall, and a flat plate extending from the bottom edge of each depending wall outwardly of said internal waveguide.

10. A high frequency heating unit according to claim 9 further comprising a spacer means on said bottom wall and engaged by said plates for keeping the distance between said plates and said bottom wall substantially constant while said internal waveguide is rotating, said spacer means being made of resin.

11. A high frequency heating device according to claim 10 in which said spacer is in the shape of a ring and said spacer is positioned to be concentric with said coupling rod and is in contact with said internal waveguide at points radially outwardly relative to said coupling rod of the center of gravity of said internal waveguide.

12. A high frequency heating unit according to claim 10 in which said spacer has a thickness less than the height thereof.

13. A high frequency heating unit according to claim 9 further comprising spacer means on said bottom wall of said chamber contacted by said plates on two depending walls for rotatably supporting said internal waveguide, whereby said internal waveguide is supported at three points, one on said coupling rod and two on said spacer means.

14. A high frequency heating unit according to claim 9 in which one depending sidewall has a radiating port therein starting at a point spaced toward said bottom wall from said inner wall and extending downwardly to the bottom edge of said sidewall and outwardly through the plate on said sidewall.

* * * * *